US008862479B2

(12) United States Patent
Shirakawa et al.

(10) Patent No.: US 8,862,479 B2
(45) Date of Patent: Oct. 14, 2014

(54) ENCODER, ENCODING SYSTEM, AND ENCODING METHOD

(75) Inventors: Miyuki Shirakawa, Fukuoka (JP); Masanao Suzuki, Kawasaki (JP); Yoshiteru Tsuchinaga, Fukuoka (JP); Yohei Kishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 486 days.

(21) Appl. No.: 13/009,018

(22) Filed: Jan. 19, 2011

(65) Prior Publication Data

US 2011/0178806 A1 Jul. 21, 2011

(30) Foreign Application Priority Data

Jan. 20, 2010 (JP) ..... 2010-010251

(51) Int. Cl.
*G10L 19/00* (2013.01)
*G10L 19/008* (2013.01)

(52) U.S. Cl.
CPC ..... *G10L 19/008* (2013.01)
USPC ..... 704/500; 704/504

(58) Field of Classification Search
USPC ..... 704/500
See application file for complete search history.

(56) References Cited

U.S. PATENT DOCUMENTS

| | | | | |
|---|---|---|---|---|
| 6,356,211 | B1 * | 3/2002 | Shimoyoshi et al. | 341/50 |
| 6,629,078 | B1 * | 9/2003 | Grill et al. | 704/500 |
| 8,150,702 | B2 * | 4/2012 | Zhou et al. | 704/503 |
| 2005/0157884 | A1 * | 7/2005 | Eguchi | 381/23 |
| 2007/0255572 | A1 * | 11/2007 | Miyasaka et al. | 704/500 |
| 2008/0097751 | A1 * | 4/2008 | Tsuchinaga et al. | 704/205 |
| 2008/0219344 | A1 | 9/2008 | Suzuki et al. | |
| 2009/0210234 | A1 * | 8/2009 | Sung et al. | 704/500 |
| 2009/0299734 | A1 * | 12/2009 | Zhou et al. | 704/201 |
| 2010/0169099 | A1 * | 7/2010 | Ashley et al. | 704/500 |
| 2010/0169100 | A1 * | 7/2010 | Ashley et al. | 704/500 |
| 2011/0129092 | A1 * | 6/2011 | Virette et al. | 381/17 |
| 2011/0178806 | A1 * | 7/2011 | Shirakawa et al. | 704/500 |

FOREIGN PATENT DOCUMENTS

| | | | |
|---|---|---|---|
| JP | 2005-523480 | 8/2005 | |
| JP | 2007-183528 | 7/2007 | |
| JP | 2008-224902 | 9/2008 | |
| JP | 1916652 B1 * | 6/2010 | G10L 21/02 |
| WO | WO 03/090208 | 10/2003 | |

OTHER PUBLICATIONS

Ralph, Sperschneider "Subpart 8: Technical description of parametric coding for high quality audio," ISO/IEC 14496-3:2005(E), Apr. 1, 2005, pp. 42-65 (relevant portions).

Jeroen, Breebaart et al., "High-quality parametric spatial audio coding at low bit rates", AES 116th Convention, Berlin, Germany May 8, 2004, pp. 1-13.

* cited by examiner

*Primary Examiner* — Jialong He
*Assistant Examiner* — Jie Shan
(74) *Attorney, Agent, or Firm* — Fujitsu Patent Center

(57) ABSTRACT

An encoding device includes, an estimation unit to estimate a decoded signal of a plurality of channels based on a down-mix signal obtained by down-mixing an input signal of the plurality of channels, similarity between the channels of the input signal, and an intensity difference between the channels of the input signal; an analysis unit to analyze a phase of the input signal and a phase of the decoded signal; a calculation unit to calculate phase information based on the phase of the input signal and the phase of the decoded signal; and a coding unit to encode the similarity between the channels of the input signal, the intensity difference between the channels of the input signal, and the phase information.

8 Claims, 18 Drawing Sheets

FIG. 16

161

| INDEX | 0 | 1 | 2 | 3 | 4 | 5 | 6 | 7 |
|---|---|---|---|---|---|---|---|---|
| $\rho$ | 1 | 0.937 | 0.84118 | 0.60092 | 0.36764 | 0 | -0.589 | -1 |

FIG. 17

162

| INDEX | -7 | -6 | -5 | -4 | -3 | -2 | -1 | 0 |
|---|---|---|---|---|---|---|---|---|
| IID[dB] | -25 | -18 | -14 | -10 | -7 | -4 | -2 | 0 |
| INDEX | 1 | 2 | 3 | 4 | 5 | 6 | 7 | |
| IID[dB] | 2 | 4 | 7 | 10 | 14 | 18 | 25 | |

ENCODER, ENCODING SYSTEM, AND ENCODING METHOD

CROSS-REFERENCE TO RELATED APPLICATIONS

This application is based upon and claims the benefit of priority of the prior Japanese Patent Application No. 2010-010251, filed on Jan. 20, 2010, the entire contents of which are incorporated herein by reference.

FIELD

The embodiments discussed herein relate to an encoder, an encoding system, and an encoding method.

BACKGROUND

Conventionally, there is a technology to encode an input signal having a plurality of channels based on spatial information. As one example of encoding an audio signal, for example, there is a parametric stereo coding technology. The parametric stereo coding technology is employed by High-Efficiency Advanced Audio Coding (HE-AAC) version 2 (hereinafter, called HE-AACv2) of Moving Picture Experts Group (MPEG)-4 audio standard (ISO/IEC 14496-3) specified by International Organization for Standardization (ISO)/International Electrotechnical Commission (IEC). The parametric stereo coding technology uses the following four types of spatial information: Inter-channel Intensity Differences (IID) that is an intensity difference between channels of an input signal, Inter-channel Coherence (ICC) that is similarity between channels of an input signal, Inter-channel Phase Differences (IPD) that is a phase difference between channels of an input signal, and Overall Phase Differences (OPD) that is a phase difference between original sound (an input signal before encoding) and a monaural signal.

Meanwhile, a technology that decodes a signal encoded by the parametric stereo coding technology is standardized by MPEG-4 audio standard (ISO/IEC 14496-3). The standardized decoding technologies include a decoding technology that uses the above-described four types of spatial information (Unrestricted version, hereinafter called a full specification version) and that uses the above-described two types of spatial information that are IID and ICC to achieve low amount of calculation (Baseline version, hereinafter called a simplified version). The decoding process of the full specification version is represented by the following expression (1). The decoding process of the simplified specification version is represented by the following expression (2).

Expression 1

$$\begin{bmatrix} L \\ R \end{bmatrix} = \begin{bmatrix} c_2 & 0 \\ 0 & c_1 \end{bmatrix} \begin{bmatrix} \cos(\alpha) & \sin(\alpha) \\ \cos(-\alpha) & \sin(-\alpha) \end{bmatrix} \begin{bmatrix} e^{jOPD} & 0 \\ 0 & e^{j(IPD-OPD)} \end{bmatrix} \begin{bmatrix} M \\ D \end{bmatrix} \tag{1}$$

Expression 2

$$\begin{bmatrix} L \\ R \end{bmatrix} = \begin{bmatrix} c_2 & 0 \\ 0 & c_1 \end{bmatrix} \begin{bmatrix} \cos(\alpha) & \sin(\alpha) \\ \cos(-\alpha) & \sin(-\alpha) \end{bmatrix} \begin{bmatrix} M \\ D \end{bmatrix} \tag{2}$$

In the expressions (1) and (2), the L is a signal of an L channel of an audio signal, while the R is a signal of an R channel of the audio signal. The M indicates a monaural signal of the audio signal, and the D indicates a reverberation signal of the audio signal. The $c_1$ is represented by the following expression (3). The $c_2$ is represented by the following expression (4). The c in the expression (3) and the expression (4) is represented by the following expression (5). In the expression (5), the IID is an intensity difference between the channels. The IID is represented by the following expression (6). In the expression (6), the $e_L$ is a self correlation of the L channel signal and the $e_R$ is a self correlation of the R channel signal.

Expression 3

$$c_1 = \frac{\sqrt{2}}{\sqrt{1+c^2}} \tag{3}$$

Expression 4

$$c_2 = \frac{\sqrt{2}\,c}{\sqrt{1+c^2}} \tag{4}$$

Expression 5

$$c = 10^{\frac{IID}{20}} \tag{5}$$

Expression 6

$$IID = 10\log_{10}\left(\frac{e_L}{e_R}\right) \tag{6}$$

The "α" in the expressions (1) and (2) is represented by the following expression (7). The "$\alpha_0$" in the expression (7) is represented by the following expression (8). In the expression (8), the ICC is similarity between the channels. The ICC is represented by the following expression (9). In the expression (9), the $e_{LR}$ is a cross correlation between the L-channel signal and the R-channel signal.

Expression 7

$$\alpha = \alpha_0 + \frac{\alpha_0(c_1 - c_2)}{\sqrt{2}} = \left(1 + \frac{(c_1 - c_2)}{\sqrt{2}}\right)\alpha_0 \tag{7}$$

Expression 8

$$\alpha_0 = \frac{1}{2}\arccos(ICC) \tag{8}$$

Expression 9

$$ICC = \frac{|e_{LR}|}{\sqrt{e_L e_R}} \tag{9}$$

In the expression (1), the IPD is a phase difference between the channels. The IPD is represented by the following expression (10). The OPD is a phase difference between the original sound and the monaural signal. The OPD is represented by the following expression (11). In the expression (11), $e_{LM}$ is a cross correlation between the L channel signal of the original sound and the monaural signal. The monaural signal is obtained by down-mixing the L channel signal and the R channel signal of the original sound. In the expressions (10) and (11), the "Re" indicates a real part while "Inn" indicates an imaginary part.

Expression 10

$$IPD = \angle e_{LR} = \arctan\left(\frac{\mathrm{Im}(e_{LR})}{\mathrm{Re}(e_{LR})}\right) \tag{10}$$

Expression 11

$$OPD = \angle e_{LM} = \arctan\left(\frac{\mathrm{Im}(e_{LM})}{\mathrm{Re}(e_{LM})}\right) \tag{11}$$

According to the expressions (9) and (10), similarity between the channels the ICC, and a phase difference between the channels, the IPD include a cross correlation $e_{LR}$ between the L channel signal and the R channel signal. In other words, both the similarity between the channels (ICC), and the phase difference between the channels (IPD) include phase information. Accordingly, phase information included in the phase difference between the channels (IPD), and phase information included in the similarity between the channels (ICC) is redundantly added to signals decoded by using the full specification decoding technology. As a result, signals decoded by the full specification version differ from the signals before encoding. Thus, there is a method to generate similarity between the channels (ICC) without including the phase information. When similarity between the channels (ICC) does not include the phase information, signals before encoding may be reproduced by the full specification version decoding technology.

SUMMARY

In accordance with an aspect of the embodiments, an encoding device includes an estimation unit to estimate a decoded signal of a plurality of channels based on a down-mix signal obtained by down-mixing an input signal of the plurality of channels, similarity between the channels of the input signal, and an intensity difference between the channels of the input signal; an analysis unit to analyze a phase of the input signal and a phase of the decoded signal; a calculation unit to calculate phase information based on the phase of the input signal and the phase of the decoded signal; and a coding unit to encode the similarity between the channels of the input signal, the intensity difference between the channels of the input signal, and the phase information.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 16 illustrates an example of a similarity quantization table of the encoder according to the third embodiment.

FIG. 17 illustrates an example of an intensity difference quantization table of the encoder according to the third embodiment.

DESCRIPTION OF EMBODIMENTS

Figure 1:
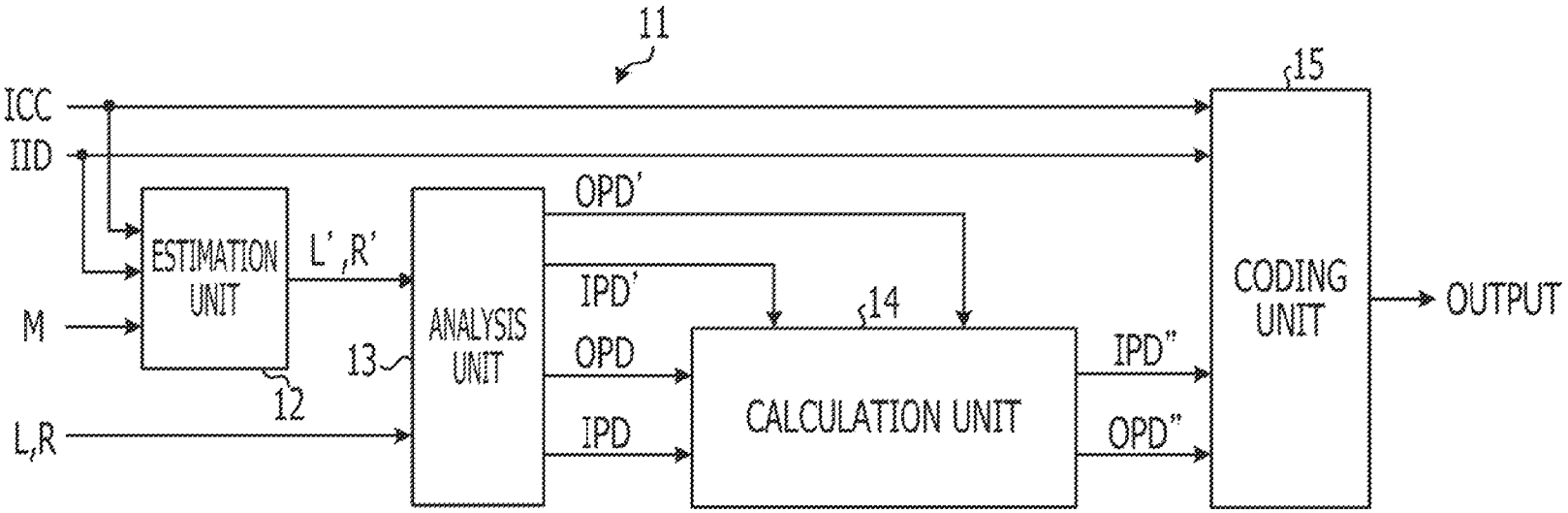
FIG. 1 is a block diagram illustrating an encoder according to a first embodiment.

Hereinafter, embodiments of the encoder, the encoding system, and the encoding method will be described in detail by referring to the accompanying drawings. According to the encoder, the encoding system, and the encoding method, a phase difference between the channels (IPD" which will be described later) is generated by removing a phase component included in similarity between the channels, ICC. Thus, overlapping of phase components of similarity between the channels, ICC and phase difference of channels (IPD" which will be described later) is avoided. As an example of a signal that is subject to be encoded, for example, an audio signal may be considered. As one example of technologies to encode an audio signal, for example, there is a parametric stereo coding technology. In the descriptions of each of the embodiments hereinafter, the same reference numeral is applied to the same component and the overlapped description will be omitted.

FIG. 1 is a block diagram illustrating an encoder according to the first embodiment. As illustrated in FIG. 1, an encoder 11 includes an estimation unit 12, an analysis unit 13, a calculation unit 14, and a coding unit 15. In FIG. 1, the L and R are signals of respective channels of an input signal having a plurality of channels. The M is a down-mix signal (monaural signal) obtained by down-mixing the L channel signal and the R channel signal of the input signal. The ICC is similarity between the L channel signal and the R channel signal of the input signal. The IID is an intensity difference between the L channel signal and the R channel signal of the input signal.

The estimation unit 12 estimates decoded signals L' and R' having a plurality of channels based on the down mix signal M, the similarity between the channels of the input signals L and R, ICC, and an intensity difference between the channels of the input signals L and R, IID. The L' is an L channel signal of the decoded signal estimated by the estimation unit 12. The R' is an R channel signal of the decoded signal estimated by the estimation unit 12. The analysis unit 13 analyzes phases IPD and OPD of the input signals L and R. The analysis unit 13 analyzes phases IPD' and OPD' of the decoded signals L' and R' estimated by the estimation unit 12. The calculation unit 14 calculates phase information IPD" and OPD" based on the phases IPD and OPD of the input signals L and R and the phases IPD' and OPD' of the decoded signals L' and R' estimated by the estimation unit 12. The coding unit 15 encodes and outputs a similarity between the channels of the input signals L and R, ICC, an intensity difference between the channels of the input signals L and R, IID, and the phase information IPD" and OPD" calculated by the calculation unit 14. Data that is output from the coding unit 15 is multiplexed with data obtained by encoding the down mix signal M and is transmitted, for example, to a device at a decoding process side, which is not illustrated.

The IPD, IPD', and IPD" are a phase difference between the L channel signal and the R channel signal. The OPD, OPD', and OPD" are a phase difference between the L channel signal or the R channel signal, and the down mix signal (monaural signal) M. The analysis unit 13 may analyze both or one of the IPD' and the OPD'. The analysis unit 13 analyzes the IPD' of the decoded signals L' and R' when the analysis unit 13 analyzes the IPD of the input signals L and R. The analysis unit 13 analyzes the OPD' of the decoded signals L' and R' when the analysis unit analyzes the OPD of the input signals L and R.

The calculation unit 14 may calculate the phase information IPD" based on the difference between the IPD of the input signals L and R and the IPD' of the decoded signal L' and R'. The calculation unit 14 may calculate the phase information OPD" based on the difference between the OPD of the input signals L and R and the OPD' of the decoded signals L' and R'.

Figure 2:
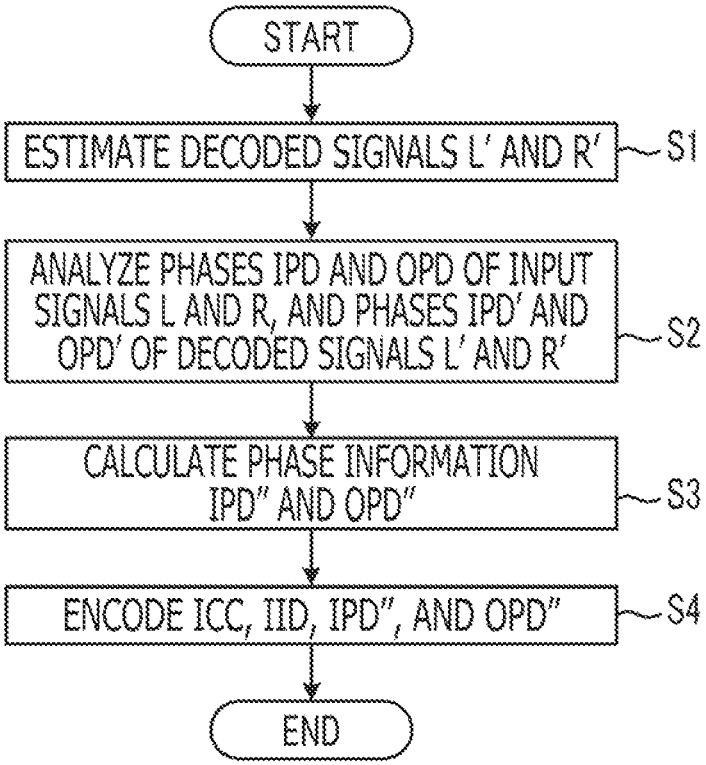
FIG. 2 is a flowchart illustrating an encoding method according to the first embodiment.

FIG. 2 is a flowchart illustrating the encoding method according to the first embodiment. As illustrated in FIG. 2, when an encoding process starts, the estimation unit 12 of the encoder 11 estimates decoded signals L' and R' based on the down mix signal M, similarity between the channels of input signals L and R, ICC, and the intensity difference between the channels of the input signals L and R, IID (operation S1). The analysis unit 13 of the encoder 11 analyzes phases IPD and OPD of the input signals L and R. The analysis unit 13 of the encoder 11 analyzes phases IPD' and OPD' of the decoded signals L' and R' (operation S2). The calculation unit 14 of the encoder 11 calculates phase information IPD" and OPD" based on the IPD and OPD, and the IPD' and the OPD' (operation S3). The coding unit 15 of the encoder 11 encodes similarity between the channels of the input signals L and R, ICC, an intensity difference between the channels of the input signals L and R, IID, and the phase information IPD" and OPD" calculated at operation S3 (operation S4). Accordingly, the series of the encoding processes are completed.

In operation S2, the encoder 11 may analyze the IPD and IPD' without analyzing the OPD and OPD'. Alternatively, the encoder 11 may analyze the OPD and OPD' without analyzing the IPD and IPD'. In operation S3, the encoder 11 may calculate IPD" based on a difference between the IPD and the IPD'. The encoder 11 may calculate OPD" based on a difference between the OPD and the OPD'.

According to the first embodiment, the decoded signals L' and R' correspond to signals decoded by the simplified version decoding technology. Accordingly, a difference of phases between the input signals L and R and signals decoded by the simplified version decoding technology may be obtained by calculating the phase information IPD" and OPD" based on the phases IPD and OPD of the input signals L and R and phases IPD' and OPD' of the decoded signals L' and R'. The device at the decoding processing side receives data obtained by encoding similarity between the channels of the input signals L and R, ICC, an intensity difference between the channels of the input signals L and R, IID, the phase information IPD" and OPD", and for example, data obtained by encoding the down-mix signal M from the encoder 11 and decodes the received data. The phase included in the similarity between the channels, ICC is added to the signals decoded by the device at the decoding process side by using the simplified decoding technology. Thus the signals before encoding may be reproduced. The phase included in the similarity between the channels, ICC and moreover a difference between phases of the input signals L and R and phases of the signals decoded by the simplified decoding technology are added by the phase information IPD" and OPD" to the signals decoded by the device at the decoding process side by using the full specification decoding technology. Thus the signals before encoding may be reproduced. Accordingly, the encoder 11 may encode signals so that signals before encoding may be reproduced whichever the full specification version decoding technology or the simplified decoding technology is used.

The second embodiment applies the encoder according to the first embodiment to an HE-AACv2 encoding system.

Figure 3:
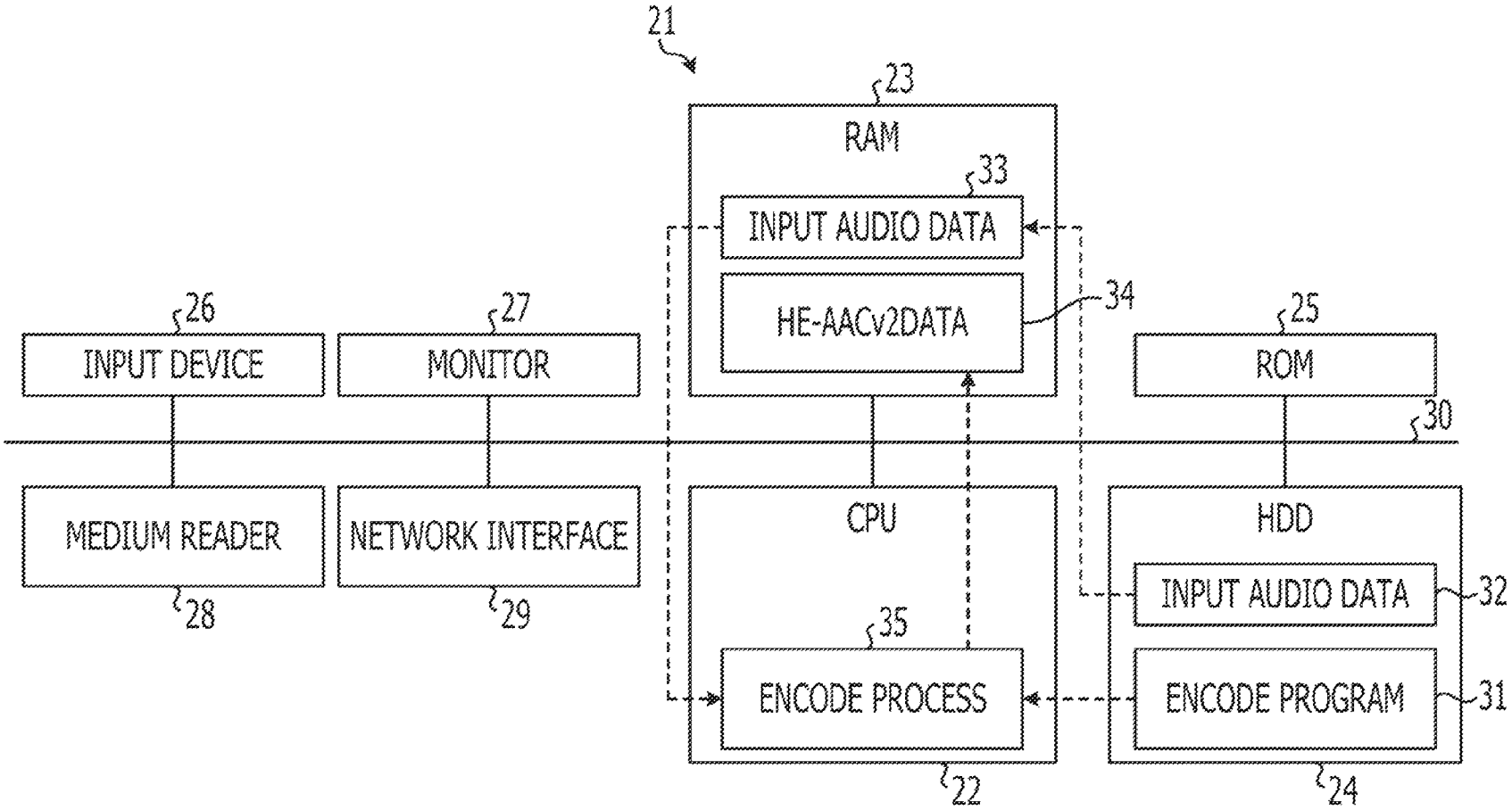
FIG. 3 is a block diagram illustrating a hardware configuration of an encoding system according to a second embodiment.

FIG. 3 is a block diagram illustrating a hardware configuration of an encoding system according to the second embodiment. As illustrated in FIG. 3, an encoding system 21 includes a Central Processing Unit (CPU) 22, a Random Access Memory (RAM) 23, a Hard Disk Drive (HDD) 24, a Read Only Memory (ROM) 25, an input device 26, a monitor 27, a medium reader 28, and a network interface 29. Each of the units is connected to a bus 30. In FIG. 3, the dashed arrow indicates a data flow.

The HDD 24 stores an encode program 31 and input audio data 32 in its internal hard disk. The encode program 31 encodes audio data and, for example, is read from a removable storage medium by the medium reader 28 and is installed in the hard disk. The HDD 24 stores the input audio data 32. The input audio data 32 is audio data that is read from a removable storage medium by the medium reader 28 or audio data received from a network through the network interface 29. The RAM 23 is used as a work area of the CPU22. The RAM 23 stores input audio data 33 that is read from the HDD 24. The RAM23 stores HE-AACv2 data 34 that is an execution result of the CPU 22. The CPU 22 reads the encode program 31 from the HDD 24, executes an encode process 35 and encodes the input audio data 33 that is read from the RAM 23. The function of the encoder according to the second embodiment is achieved by executing the encode process 35 by the CPU 22.

The ROM 25 stores programs such as a boot program, for example. The input device 26 includes a keyboard, a touch panel input pad, and a pointing device such as a mouse. The monitor 27 is a device, for example, a Cathode Ray Tube (CRT) display and a Thin Film Transistor (TFT) liquid crystal display. The medium reader 28 controls reading data including audio data from a removable storage medium such as a Digital Versatile Disk (DVD) and a memory card. The network interface 29 is connected to a network such as the Internet through a communication line and controls transmission and reception of data including audio data to and from other devices connected to the network. The network interface 29 includes a modem and a Local Area Network (LAN) adapter.

Figure 4:
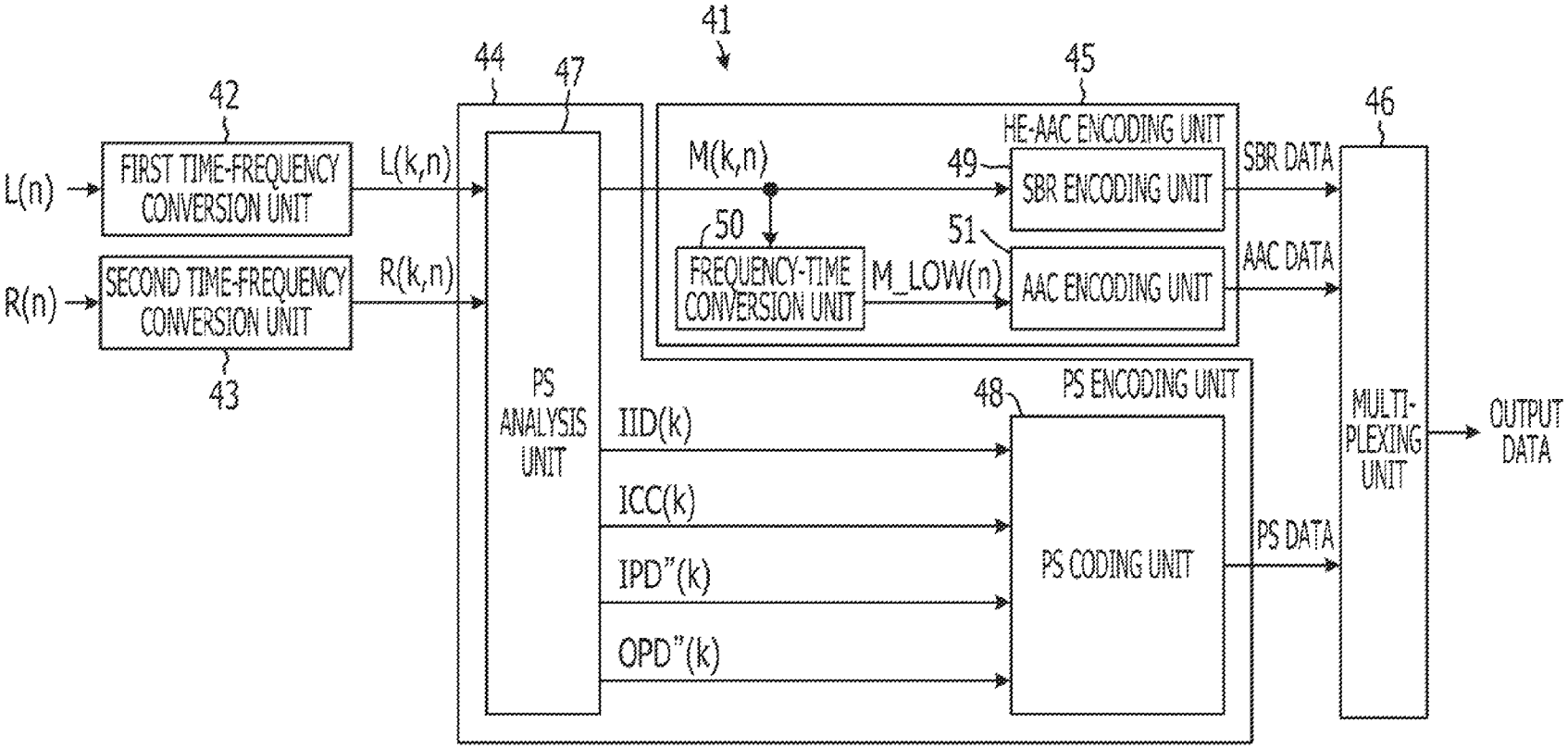
FIG. 4 is a block diagram illustrating a functional configuration of the encoding device according to the second embodiment.

FIG. 4 is a block diagram illustrating a functional configuration of the encoding system according to the second embodiment. As illustrated in FIG. 4, an encoder 41 includes a first time-frequency conversion unit 42, a second time-frequency conversion unit 43, a Parametric Stereo (PS) encoding unit 44, a High-Efficiency Advanced Audio Coding (HE-AAC) encoding unit 45, and a multiplexing unit 46. The functions of the respective units are achieved by execution of the encoding process 45 by the CPU 22. The first time-frequency conversion unit 42 converts an L channel time signal L(n) of input audio data into a frequency signal L(k, n). The second time-frequency conversion unit 43 converts an R channel time signal R(n) of input audio data into a frequency signal R(k, n). The "n" in a parenthesis is a suffix indicating time, while "k" is a suffix indicating a frequency.

Figure 5:
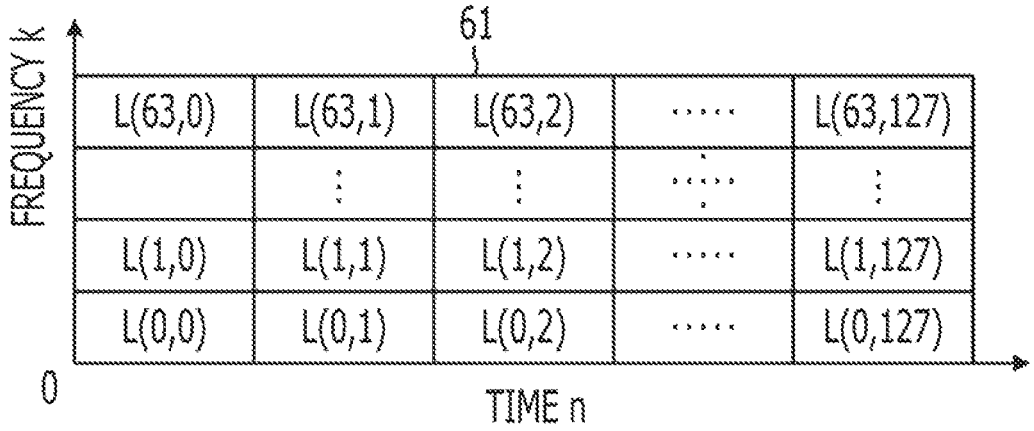
FIG. 5 illustrates time-frequency conversion of the encoder according to the second embodiment.

As the first time-frequency conversion unit 42 and the second time-frequency conversion unit 43, for example, a Quadrature Mirror Filter (QMF) bank represented in the expression (12) may be used. FIG. 5 illustrates a frequency conversion of the L channel signal. A case is illustrated in which the number of sampling of the frequency axis is 64, while that of the time axis is 128. In FIG. 5, the L(k, n) 61 is a sample of a frequency band "k" at time "n." The same applies to the R channel signal.

Expression 12

$$QMF[k][n] = \exp\left[j\frac{\pi}{128}(k+0.5)(2n+1)\right], \quad 0 \le k < 64,\ 0 \le n < 128 \tag{12}$$

The PS encoding unit 44 generates a monaural signal M(k, n) as a down-mix signal obtained by down-mixing the L channel frequency signal L(k, n) and the R channel frequency signal R(k, n). The PS encoding unit 44 encodes spatial information in the parametric stereo coding technology based on the L channel frequency signal L(k, n) and R channel frequency signal R(k, n). The PS encoding unit 44 includes a PS analysis unit 47 and a PS coding unit 48 as a third coding unit. The PS analysis unit 47 generates, as spatial information, an intensity difference between the channels, IID(k), similarity between the channels, ICC(k), and a phase difference between the channels, IPD", and a phase difference between original sound and the monaural signal, OPD"(k). The PS coding unit 48 generates PS data by encoding an intensity difference between the channels, IID(k), similarity between the channels, ICC(k), and a phase difference between the channels, IPD"(k), and a phase difference between original sound and the monaural signal, OPD"(k). The detailed configuration of the PS analysis unit 47 will be described later.

The HE-AAC encoding unit 45 generates spectral band replication (SBR) data and Advanced Audio Coding (MC) data by encoding the monaural signal M (k, n). The HE-AAC encoding unit 45 includes an SBR encoding unit 49, a frequency-time conversion unit 50 and an MC encoding unit 51. The frequency-time conversion unit 50 converts the monaural signal M (k, n) into a time signal. As the frequency-time conversion unit 50, for example, a complex type Quadrature Mirror Filter (QMF) bank represented in the expression (13) may be used.

Expression 13

$$QMF[k][n] = \frac{1}{64}\exp\left(j\frac{\pi}{64}\left(k+\frac{1}{2}\right)(2n-127)\right), \quad 0 \le k < 32,\ 0 \le n < 32 \tag{13}$$

The MC encoding unit 51 as a second coding unit generates MC data by encoding a medium-low frequency component, M_low(n) of the time-converted monaural signal. As an encoding technology of the AAC encoding unit 51, for example, a technology discussed in the Japanese Laid-open Patent Publication No. 2007-183528 may be used. The SBR encoding unit 49 as a first coding unit generates SBR data by complementing a high-frequency component of the monaural signal M(k, n) and encoding the monaural signal M(k, n). As an encoding technology of the SBR encoding unit 49, for example, a technology discussed in the Japanese Laid-open Patent Publication No. 2008-224902 may be used.

Figure 6:
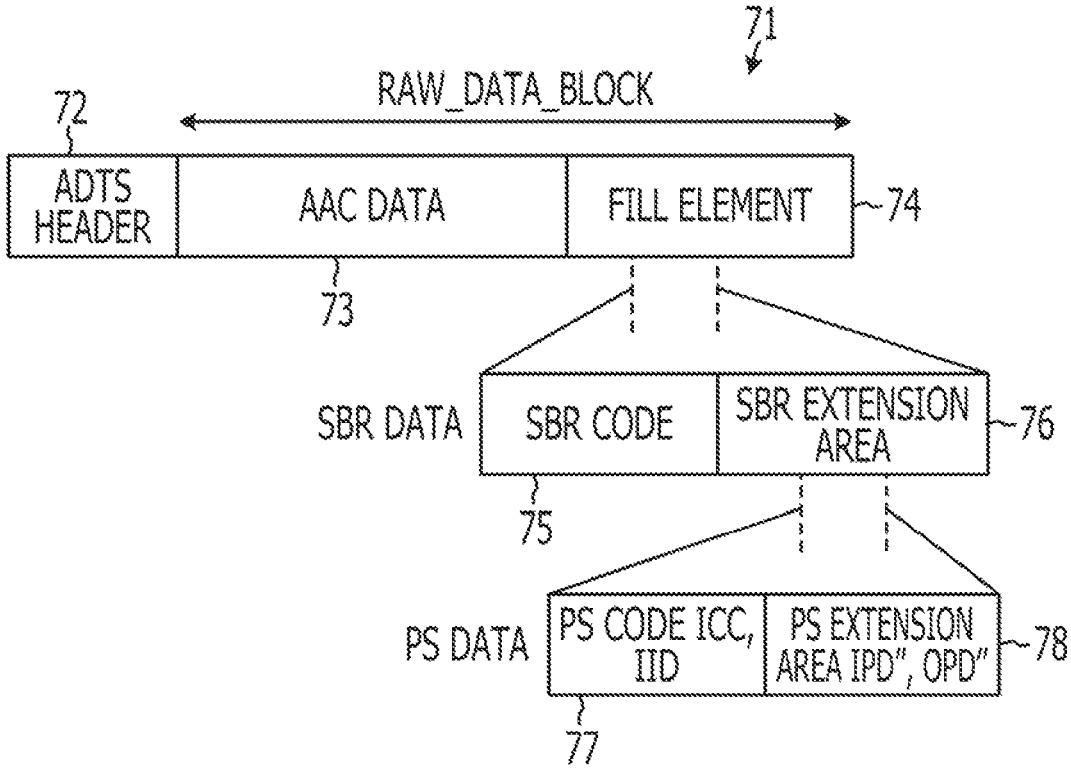
FIG. 6 illustrates an example of an MPEG-4 ADTS format.

The multiplexing unit 46 generates output data by multiplexing PS data, MC data, and SBR data. As one example of an output data format, for example, MPEG-4 Audio Data Transport Stream (ADTS) format may be considered. FIG. 6 illustrates an example of MPEG-4 ADTS format. The data 71 of the ADTS format includes fields for an ADTS header 72, an MC data 73, and a fill element 74 respectively. The field for the fill element 74 includes a field for the SBR code 75 and a field for the SBR extension area 76. The field for the SBR extension area 76 includes a field for the PS code 77 and a field for the PS extension area 78. The similarity between the channels, ICC, and an intensity difference between the channels, IID are stored in the field for the PS code 77. The phase difference between the channels, IPD", and phase difference between the original sound and the monaural signal, OPD" are stored in the field of the PS extension area 78.

Figure 7:
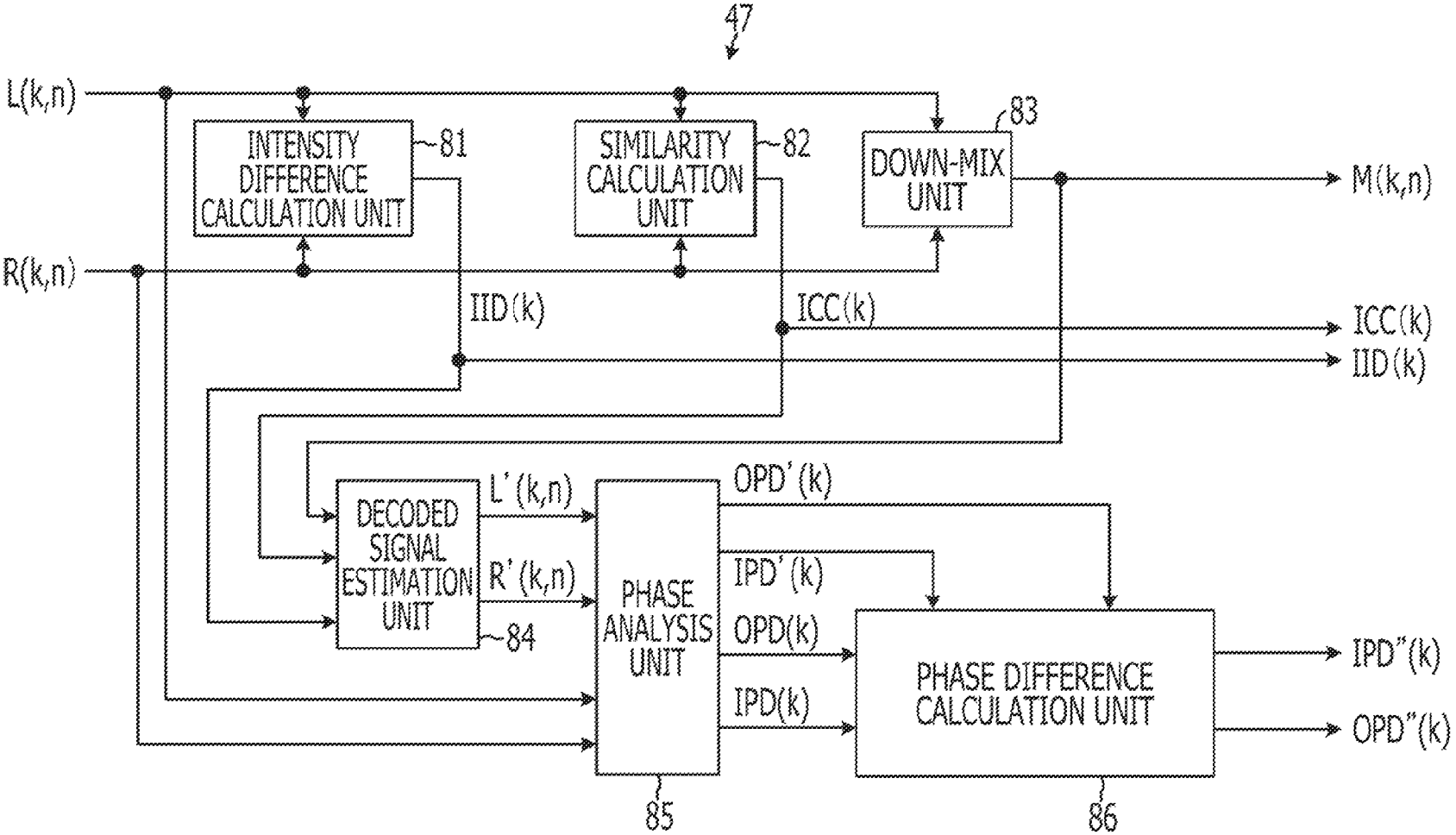
FIG. 7 is a block diagram illustrating a parametric stereo (PS) analysis unit of the encoder according to the second embodiment.

FIG. 7 is a block diagram illustrating a PS analysis unit. As illustrated in FIG. 7, the PS analysis unit 47 includes an intensity difference calculation unit 81, a similarity calculation unit 82, a down-mix unit 83, a decoded signal estimation unit 84, a phase analysis unit 85, and a phase difference calculation unit 86.

The intensity difference calculation unit 81 calculates an intensity difference between the channels, IID(k) based on the L channel frequency signal L(k, n) and the R channel frequency signal R(k, n) of an input signal. The IID(k) is represented by the following expression (14). In the expression (14), the $e_L(k)$ is a self correlation of the L channel signal in a frequency band k, and is represented by the following expression (15). The $e_R(k)$ is a self correlation of the R channel signal in a frequency band k, and is represented by the following expression (16).

Expression 14

$$IID(k) = 10\log_{10}\left(\frac{e_L(k)}{e_R(k)}\right) \tag{14}$$

Expression 15

$$e_L(k) = \sum_{n=0}^{N-1} |L[k][n]|^2 \tag{15}$$

Expression 16

$$e_R(k) = \sum_{n=0}^{N-1} |R[k][n]|^2 \tag{16}$$

The similarity calculation unit 82 calculates similarity between the channels, ICC(k) based on the L channel frequency signal L(k, n) and R channel frequency signal R(k, n) of the input signal. The ICC(k) is represented by the following expression (17). The $e_{LR}(k)$ is a cross correlation of the L channel signal and the R channel signal in the frequency band "k", and is represented by the following expression (18).

Expression 17

$$ICC(k) = \frac{|e_{LR}(k)|}{\sqrt{e_L(k)e_R(k)}} \tag{17}$$

Expression 18

$$e_{LR}(k) = \sum_{n=0}^{N-1} L[k][n] \cdot R[k][n] \tag{18}$$

The down-mix unit 83 generates a monaural signal M(k, n) as a down-mix signal obtained by down-mixing the L channel frequency signal L(k, n) and the R channel frequency signal R(k, n) of the input signal. The monaural signal M(k, n) is represented by the following expression (19). In the expression (19), the "Re" indicates a real part while "Inn" indicates an imaginary part.

Expression 19

$$\left.\begin{aligned} &M[k][n] = M_{Re}[k][n] + j \cdot M_{Im}[k][n] \\ &M_{Re}[k][n] = (L_{Re}[k][n] + R_{Re}[k][n])/2 \\ &M_{Im}[k][n] = (L_{Im}[k][n] + R_{Im}[k][n])/2 \\ &0 \le k < 64,\ 0 \le n < 128 \end{aligned}\right\} \tag{19}$$

The decoded signal estimation unit 84 generates an L channel decoded signal L'(k, n) and an R channel decoded signal R'(k, n) based on the monaural signal M(k, n), similarity between the channels, ICC(k) and an intensity difference between the channels IID(k). The detailed configuration of the decoded signal estimation unit 84 will be described later.

The phase analysis unit 85 generates, for the input signal L(k,n) and R(k,n), a phase difference between the channels, IPD(k) and a phase difference between the original sound and the monaural signal, OPD(k). The phase analysis unit 85 generates a phase difference between the channels, IPD'(k), and a phase difference between the original sound and the monaural signal, OPD'(k) for the decoded signal L'(k, n) and R'(k, n) estimated by the decoded signal estimation unit 84. The detailed configuration of the phase analysis unit 85 will be described later.

The phase difference calculation unit 86 calculates a difference between the phase difference IPD(k) of the input signal L(k, n) and R(k, n), and the phase difference IPD'(k) of the decoded signal L'(k, n) and R'(k, n). The phase difference calculation unit 86 calculates a difference between a phase difference OPD(k) for the input signal L(k, n) and R(k, n), and a phase difference OPD'(k) for the decoded signal L'(k, n) and R'(k, n). The detailed configuration of the phase difference calculation unit 86 will be described later.

Figure 8:
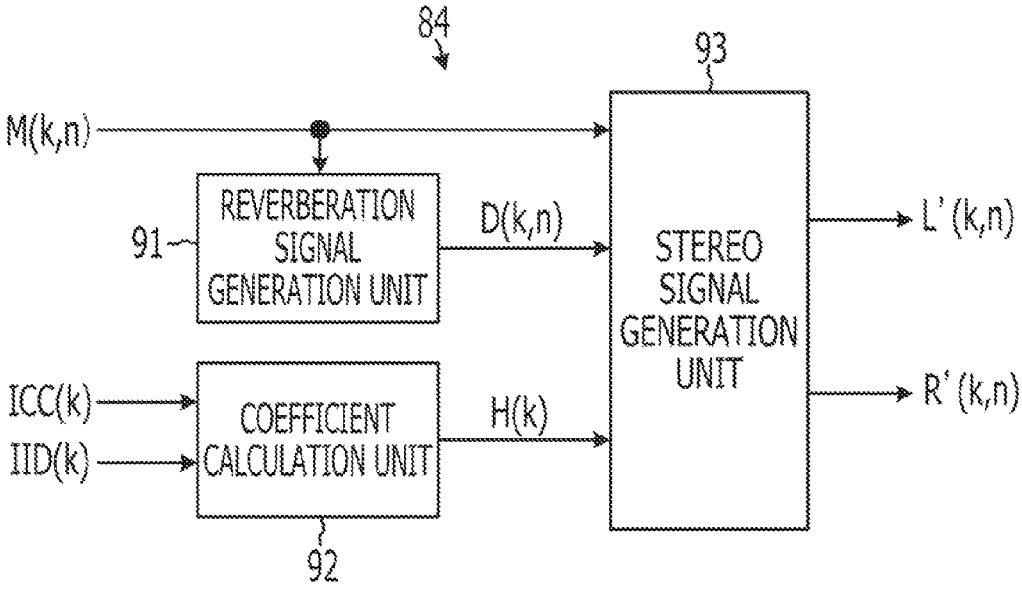
FIG. 8 is a block diagram illustrating a decoded signal estimation unit of the encoder according to the second embodiment.

FIG. 8 is a block diagram illustrating a decoded signal estimation unit. As illustrated in FIG. 8, the decoded signal estimation unit 84 includes a reverberation signal generation unit 91, a coefficient calculation unit 92, and a stereo signal generation unit 93.

The reverberation signal generation unit 91 generates a reverberation signal D(k, n) based on the monaural signal M(k, n). There are various methods to generate a reverberation signal by the reverberation signal generation unit 91. For example, a reverberation signal generation method that is disclosed in HE-AACv2 standard may be used.

The coefficient calculation unit 92 generates a coefficient matrix H(k) based on similarity between the channels, ICC(k) and an intensity difference between the channels, IID(k) of the input signals L(k, n) and R(k, n). For example, a coefficient matrix H(k) may be generated using the method disclosed in the HE-AACv2 standard. The coefficient matrix H(k) is represented by the following expression (20). The $c_1(k)$ in the expression (20) is represented by the following expression (21). The $c_2(k)$ is represented by the following expression (22). The c(k) in the expressions (21) and (22) is represented by the following expression (23). In the expression (23), the IID(k) is an intensity difference between the channels.

Expression 20

$$H(k) = \begin{bmatrix} h_{11} & h_{21} \\ h_{12} & h_{22} \end{bmatrix} = \begin{bmatrix} c_2(k) & 0 \\ 0 & c_1(k) \end{bmatrix} \begin{bmatrix} \cos(\alpha(k)) & \sin(\alpha(k)) \\ \cos(-\alpha(k)) & \sin(-\alpha(k)) \end{bmatrix} \tag{20}$$

Expression 21

$$c_1(k) = \frac{\sqrt{2}}{\sqrt{1 + c^2(k)}} \tag{21}$$

Expression 22

$$c_2(k) = \frac{\sqrt{2}\, c(k)}{\sqrt{1 + c^2(k)}} \tag{22}$$

Expression 23

$$c(k) = 10^{\frac{IID(k)}{20}} \tag{23}$$

The α(k) in the expression (20) is represented by the following expression (24). The $\alpha_0(k)$ in the expression (24) is represented by the following expression (25).

Expression 24

$$\alpha(k) = \alpha_0(k) + \frac{\alpha_0(k)(c_1(k) - c_2(k))}{\sqrt{2}} = \left(1 + \frac{(c_1(k) - c_2(k))}{\sqrt{2}}\right)\alpha_0(k) \tag{24}$$

Expression 25

$$\alpha_0(k) = \frac{1}{2}\arccos(ICC(k)) \tag{25}$$

The stereo signal generation unit 93 generates decoded signals L'(k, n) and R'(k, n) based on the monaural signal M(k, n), the reverberation signal D(k, n), and the coefficient matrix H(k). The L'(k, n) and R'(k, n) are represented by the following expression (26).

Expression 26

$$\left.\begin{aligned} L'(k, n) &= h_{11} M(k, n) + h_{12} D(k, n) \\ R'(k, n) &= h_{21} M(k, n) + h_{22} D(k, n) \end{aligned}\right\} \tag{26}$$

Figure 9:
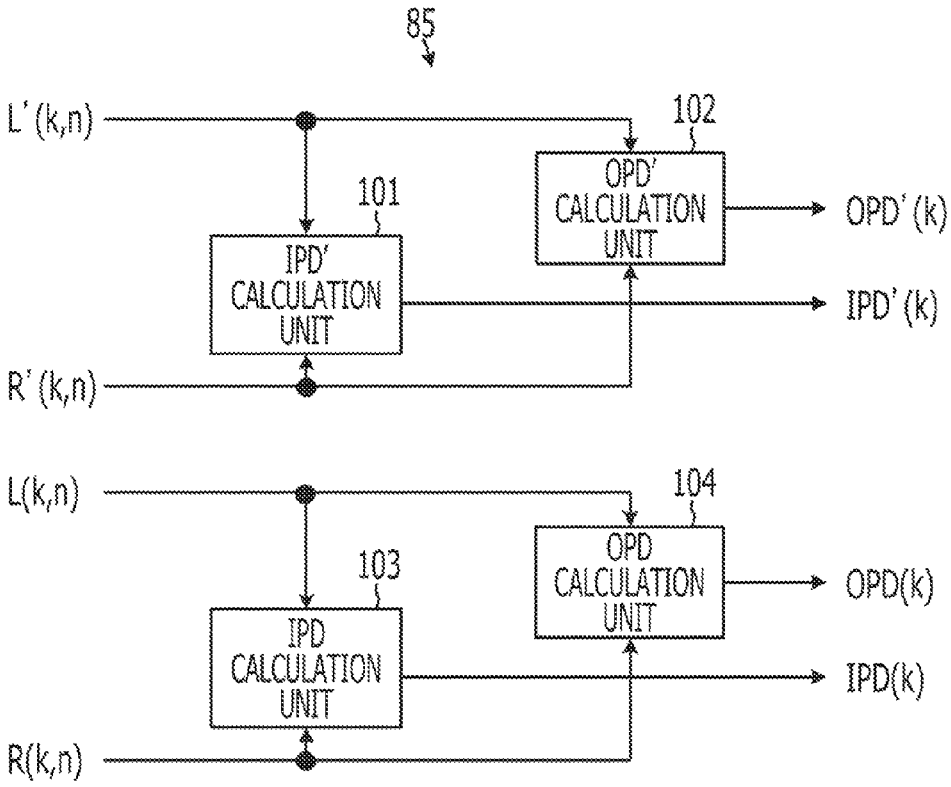
FIG. 9 is a block diagram illustrating a phase analysis unit of the encoder according to the second embodiment.

FIG. 9 is a block diagram illustrating a phase analysis unit. As illustrated in FIG. 9, the phase analysis unit 85 includes an IPD' calculation unit 101, an OPD' calculation unit 102, an IPD calculation unit 103, and an OPD calculation unit 104. The IPD' calculation unit 101 generates a phase difference between the channels IPD'(k) for the decoded signals L'(k, n) and R'(k, n). The IPD'(k) is represented by the following expression (27). In the expression (27), the $e_{L'R'}(k)$ is a cross-correlation of the L channel signal and R channel signal of the decoded signals in the frequency band "k", and is represented by the following expression (28).

Expression 27

$$IPD'(k) = \angle e_{L'R'}(k) = \arctan\left(\frac{\mathrm{Im}(e_{L'R'}(k))}{\mathrm{Re}(e_{L'R'}(k))}\right) \tag{27}$$

Expression 28

$$e_{L'R'}(k) = \sum_{n=0}^{N-1} L'[k][n] \cdot R'[k][n] \tag{28}$$

The OPD' calculation unit 102 generates a phase difference between the original sound and the monaural signal OPD'(k)

for the decoded signals L'(k,n),and R'(k,n). The OPD'(k) is represented by the following expression (29). In the expression (29), the $e_{L'M'}(k)$ is a cross-correlation between the L channel signal and the monaural signal of the decoded signal in the frequency band "k", and is represented by the following expression (30). The monaural signal M'(k, n) of the decoded signal may be generated, for example, by the OPD' calculation unit 102. The monaural signal M'(k,n) of the decoded signal is represented by the following expression (31).

Expression 29

$$OPD'(k) = \angle e_{L'M'}(k) = \arctan\left(\frac{\mathrm{Im}(e_{L'M'}(k))}{\mathrm{Re}(e_{L'M'}(k))}\right) \tag{29}$$

Expression 30

$$e_{L'M'}(k) = \sum_{n=0}^{N-1} L'[k][n] \cdot M'[k][n] \tag{30}$$

Expression 31

$$\left.\begin{aligned} &M'[k][n] = M'_{Re}[k][n] + j \cdot M'_{Im}[k][n] \\ &M'_{Re}[k][n] = (L'_{Re}[k][n] + R'_{Re}[k][n])/2 \\ &M'_{Im}[k][n] = (L'_{Im}[k][n] + R'_{Im}[k][n])/2 \\ &0 \le k < 64,\ 0 \le n < 128 \end{aligned}\right\} \tag{31}$$

The IPD calculation unit 103 generates a phase difference between the channels, IPD(k) for the input signals the L(k, n), and R(k, n). The IPD(k) is represented by the following expression (32). The $e_{LR}(k)$ in the expression (32) is represented by the above-described expression (18).

Expression 32

$$IPD(k) = \angle e_{LR}(k) = \arctan\left(\frac{\mathrm{Im}(e_{LR}(k))}{\mathrm{Re}(e_{LR}(k))}\right) \tag{32}$$

The OPD calculation unit 104 generates a phase difference between the original sound and the monaural signal, OPD(k). The OPD(k) is represented by the following expression (33). In the expression (33), the $e_{LM}(k)$ is a cross-correlation between the L channel signal and the monaural signal of the input signal in the frequency band "k" and is represented by the following expression (34). The monaural signal M(k, n) of the input signal may be generated, for example, by the OPD calculation unit 104 or by the above described down-mix unit 83. The monaural signal M(k,n) of the input signal is represented by the above-described expression (19).

Expression 33

$$OPD(k) = \angle e_{LM}(k) = \arctan\left(\frac{\mathrm{Im}(e_{LM}(k))}{\mathrm{Re}(e_{LM}(k))}\right) \tag{33}$$

Expression 34

$$e_{LM}(k) = \sum_{n=0}^{N-1} L[k][n] \cdot M[k][n] \tag{34}$$

Figure 10:
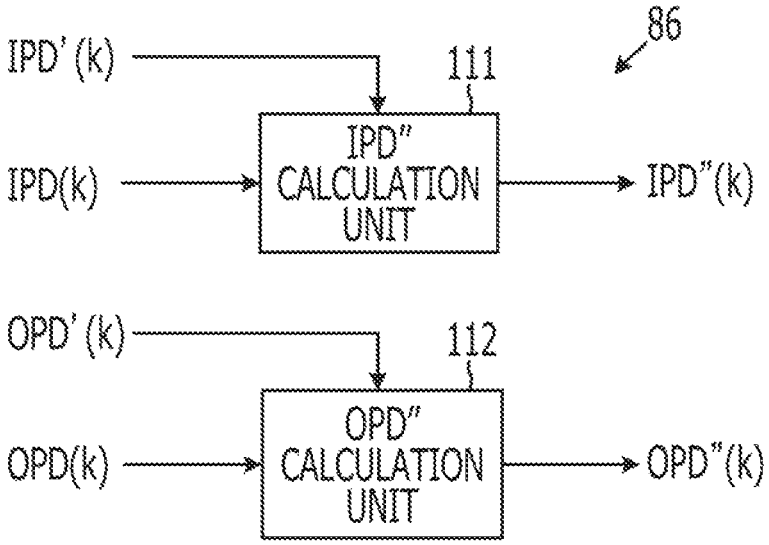
FIG. 10 is a block diagram illustrating a phase difference calculation unit of the encoder according to the second embodiment.

FIG. 10 is a block diagram illustrating a phase difference calculation unit. As illustrated in FIG. 10, the phase difference calculation unit 86 includes an IPD" calculation unit 111 and an OPD" calculation unit 112. The IPD" calculation unit 111 calculates, as illustrated in the following expression (35), a difference IPD"(k) between a phase difference of the input signal IPD(k) and a phase difference of the decoded signal IPD'(k). The phase difference calculation unit 86, as represented by the following expression (36), calculates a difference OPD"(k) between a phase difference of the input signal OPD (k) and a phase difference of the decoded signal OPD' (k).

Expression 35

$$\mathrm{IPD}''(k) = \mathrm{IPD}(k) - \mathrm{IPD}'(k) \tag{35}$$

Expression 36

$$\mathrm{OPD}''(k) = \mathrm{OPD}(k) - \mathrm{OPD}'(k) \tag{36}$$

Figure 11:
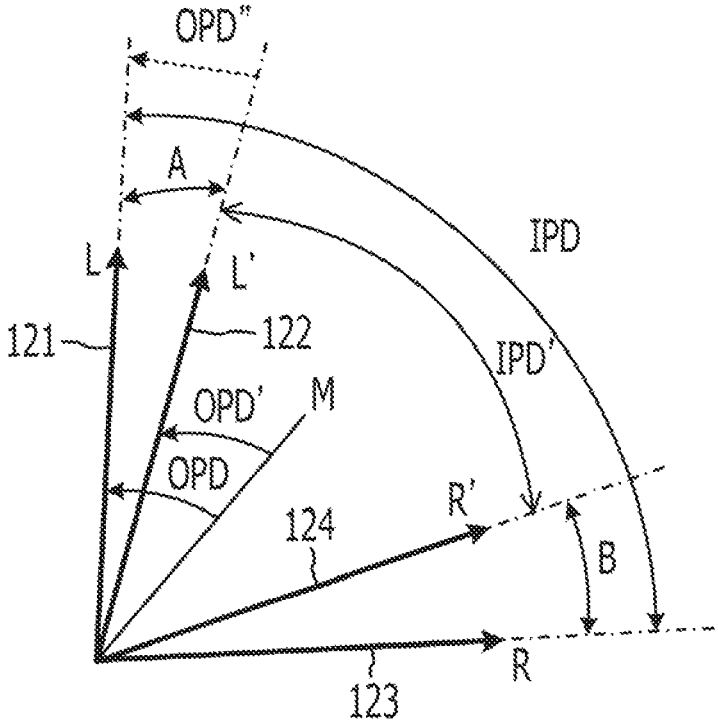
FIG. 11 illustrates a phase difference between input signals and estimated decoded signals in the encoder according to the second embodiment.

FIG. 11 illustrates a phase difference between an input signal and an estimated decoded signal. As illustrated in FIG. 11 and the following expression (37), the IPD"(k) is obtained by adding a difference A and a difference B, where the difference A is a difference between the L channel signal of the input signal L(k, n) 121 and the L channel signal of the estimated decoded signal L'(k, n) 122 and the difference B is a difference between the R channel signal of the input signal R(k, n) 123 and the R channel signal of the estimated decoded signal R'(k, n) 124.

Expression 37

$$\mathrm{IPD}''(k) = A + B = \mathrm{IPD}(k) - \mathrm{IPD}'(k) \tag{37}$$

Figure 12:
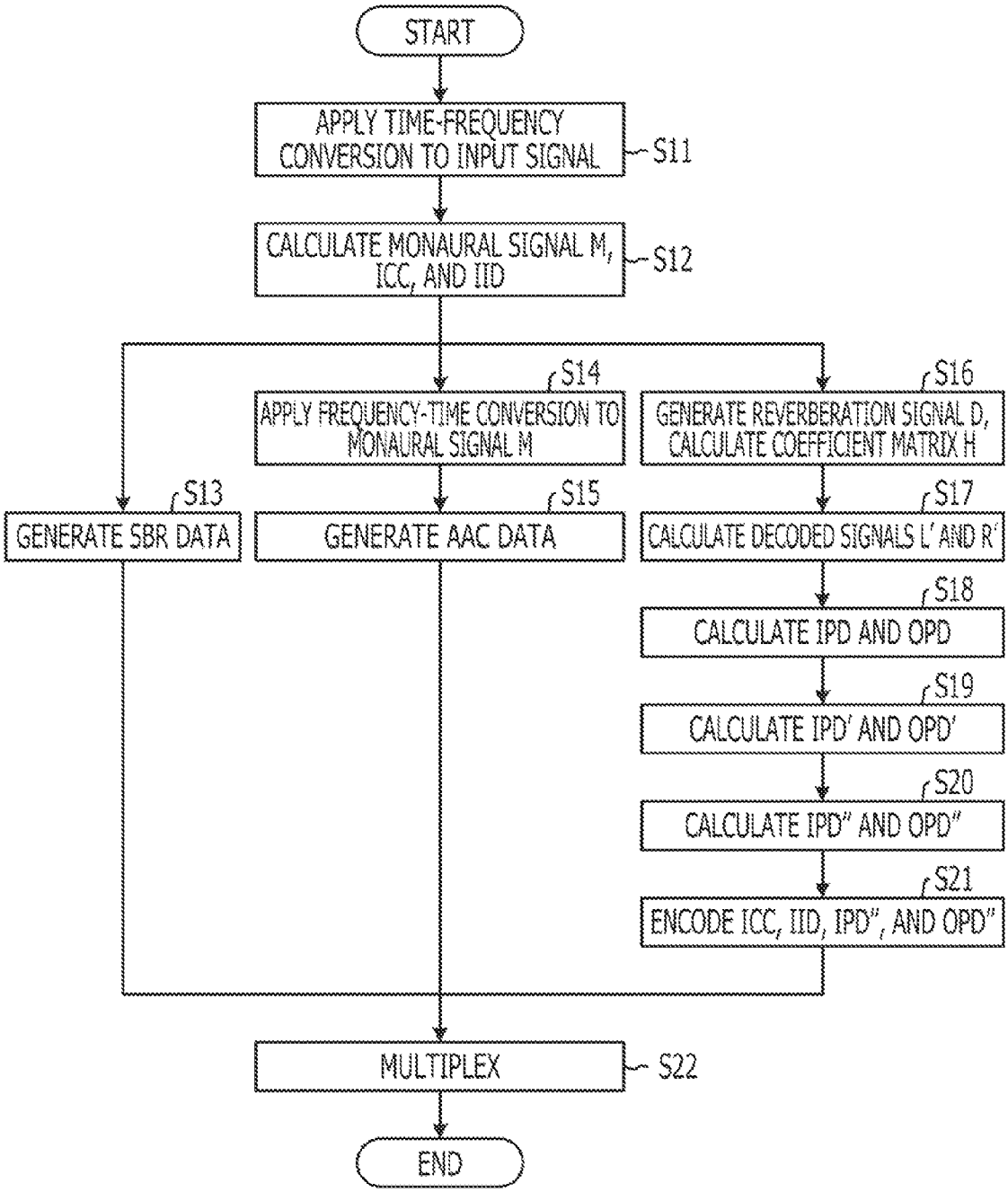
FIG. 12 is a flowchart illustrating an encoding method according to the second embodiment.

FIG. 12 is a flowchart illustrating an encoding method according to the second embodiment. As illustrated in FIG. 12, when the encoding process starts, a first time-frequency conversion unit 42 of the encoder 41 converts the L channel time signal L(n) of the input signal into a frequency signal L(k, n). A second time-frequency conversion unit 43 converts an R channel time signal R(n) of the input signal into a frequency signal R(k, n) (operation S11). The down-mix unit 83 of the encoder 41 calculates a monaural signal M(k, n) by down-mixing the L channel frequency signal L(k, n) and the R channel frequency signal R(k, n) of the input signal. The intensity difference calculation unit 81 calculates an intensity difference between the channels, IID(k) and the similarity calculation unit 82 of the encoder 41 calculates the similarity between the channels, ICC(k) (operation S12).

The SBR encoding unit 49 of the encoder 41 generates SBR data from the monaural signal M(k, n) (operation S13). Meanwhile, the frequency-time conversion unit 50 of the encoder 41 applies frequency-time conversion to the monaural signal M(k, n) to obtain a time signal (operation S14). The AAC encoding unit 51 of the encoder 41 generates MC data from the monaural signal to which time-conversion is applied (operation S15).

For example, the reverberation signal generation unit 91 of the encoder 41 generates a reverberation signal D(k, n) from the monaural signal M(k, n) in parallel with the operations S13, S14, and S15. The coefficient calculation unit 92 of the encoder 41 calculates a coefficient matrix H(k) based on the IID(k) and ICC(k) (operation S16). The stereo signal generation unit 93 of the encoder 41 generates decoded signals L'(k, n) and R'(k, n) based on the monaural signal M(k, n), the reverberation signal D(k, n), and the coefficient matrix H(k) (operation S17).

For the input signals L(k, n) and R(k, n), the IPD calculation unit 103 of the encoder 41 calculates a phase difference between the channels, IPD(k), and the OPD calculation unit 104 of the encoder 41 calculates a phase difference between the original sound and the monaural signal, OPD(k) (operation S18). For the decoded signals L'(k, n) and R'(k, n), the IPD' calculation unit 101 of the encoder 41 calculates a phase difference between the channels, IPD'(k), and the OPD' calculation unit 102 of the encoder 41 calculates a phase difference between the original sound and the monaural signal, OPD'(k) (operation S19). The order of the operations S18 and S19 may be changed.

The IPD" calculation unit 111 of the encoder 41 calculates a difference IPD"(k) and the OPD" calculation unit 112 of the encoder 41 calculates a difference OPD"(k), where the difference IPD"(k) is a difference between a phase difference IPD(k) of the input signal and a phase difference IPD'(k) of the decoded signal, and the difference OPD"(k) is a difference between a phase difference of the input signal OPD(k) and a phase difference of the decoded signal OPD'(k) (operation S20). The order to calculate the IPD"(k) and the OPD"(k) may be changed. The PS coding unit 48 of the encoder 41 encodes the ICC, the IID, the IPD", and the OPD" to generate PS data (operation S21). The multiplexing unit 46 of the encoder 41 generates output data by multiplexing the PS data, the AAC data, and the SBR data (operation S22). Accordingly, the series of the encoding processes are completed.

Figure 13:
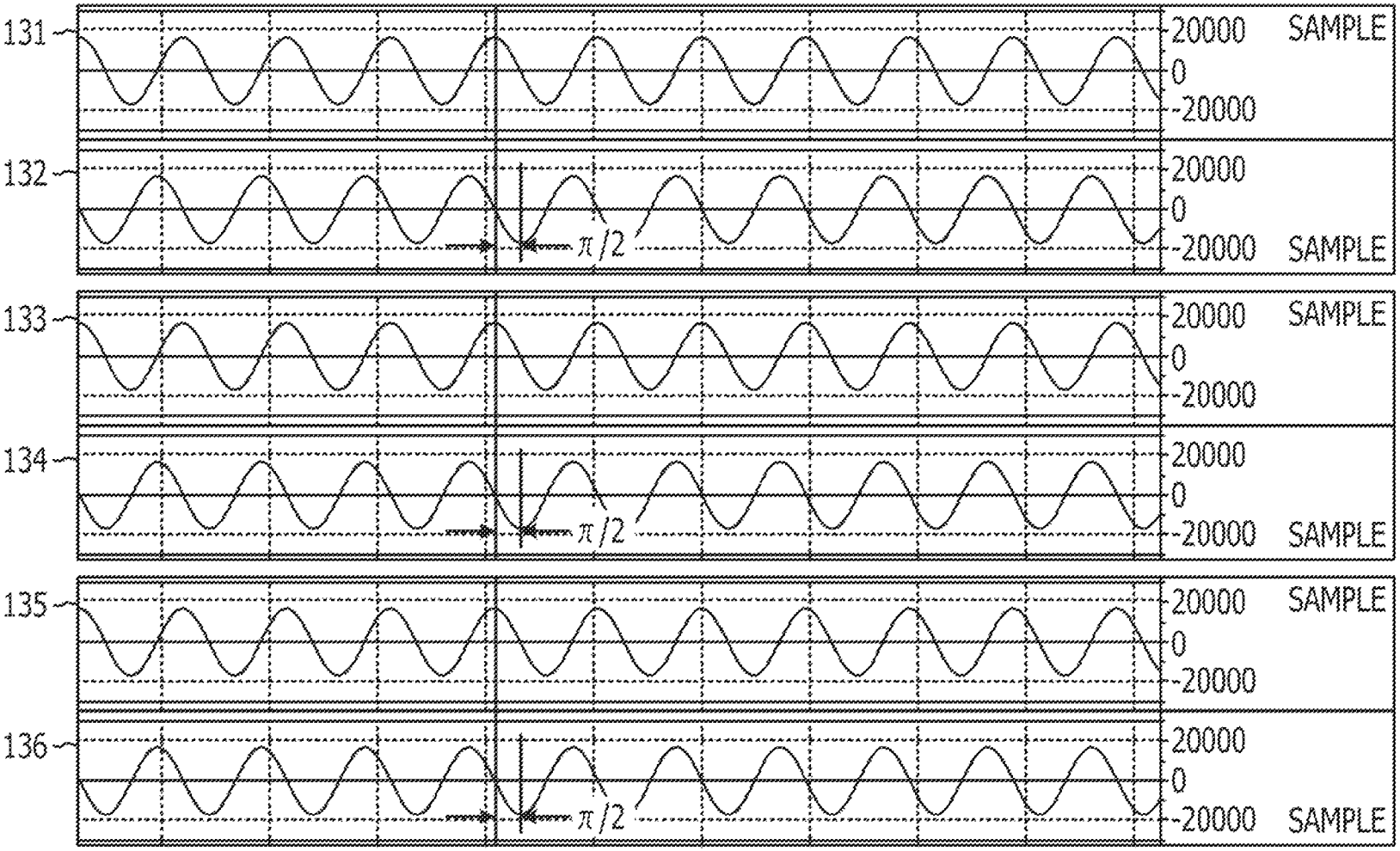
FIG. 13 is a waveform chart illustrating waveforms of decoded signals according to the second embodiment.
Figure 18:
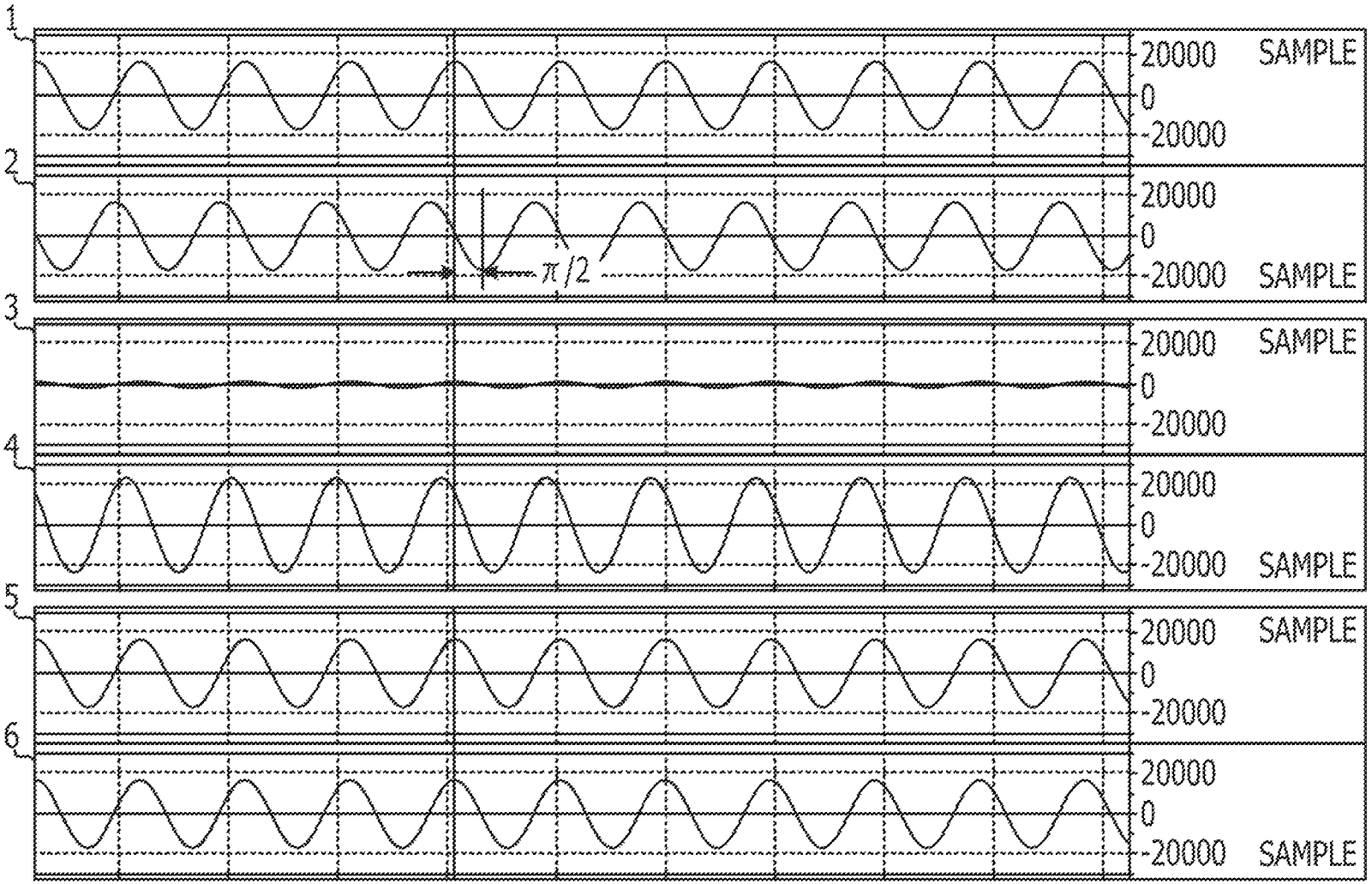
FIG. 18 is a waveform chart illustrating waveforms of decoded signals according to the embodiments.

According to the second embodiment, substantially the same advantages as the first embodiment may be achieved. FIG. 13 illustrates waveforms before encoding and after decoding a signal according to the second embodiment. In FIG. 13, the waveforms 131 and 132 are waveforms of two signals before encoding and substantially the same as the waveforms 1 and 2 illustrated in FIG. 18. The waveforms 133 and 134 are obtained by encoding signals of the waveforms 131 and 132 according to the second embodiment and decoding by using the full specification version decoding technology. The waveforms 135 and 136 are obtained by encoding signals of the waveforms 131 and 132 according to the second embodiment, and decoding by using the simplified specification version decoding technology. As may be seen from FIG. 13, according to the second embodiment, encoding may be achieved so that a signal before encoding may be reproduced whichever the full specification version or the simplified version is used for decoding.

According to the third embodiment, a monaural signal M(k, n) is encoded once and decoded, and similarity between the channels, ICC(k), and an intensity difference between channels, IID(k) are quantized once and inverse-quantized, and decoded signals L'(k, n) and R'(k, n) are calculated.

Figure 14:
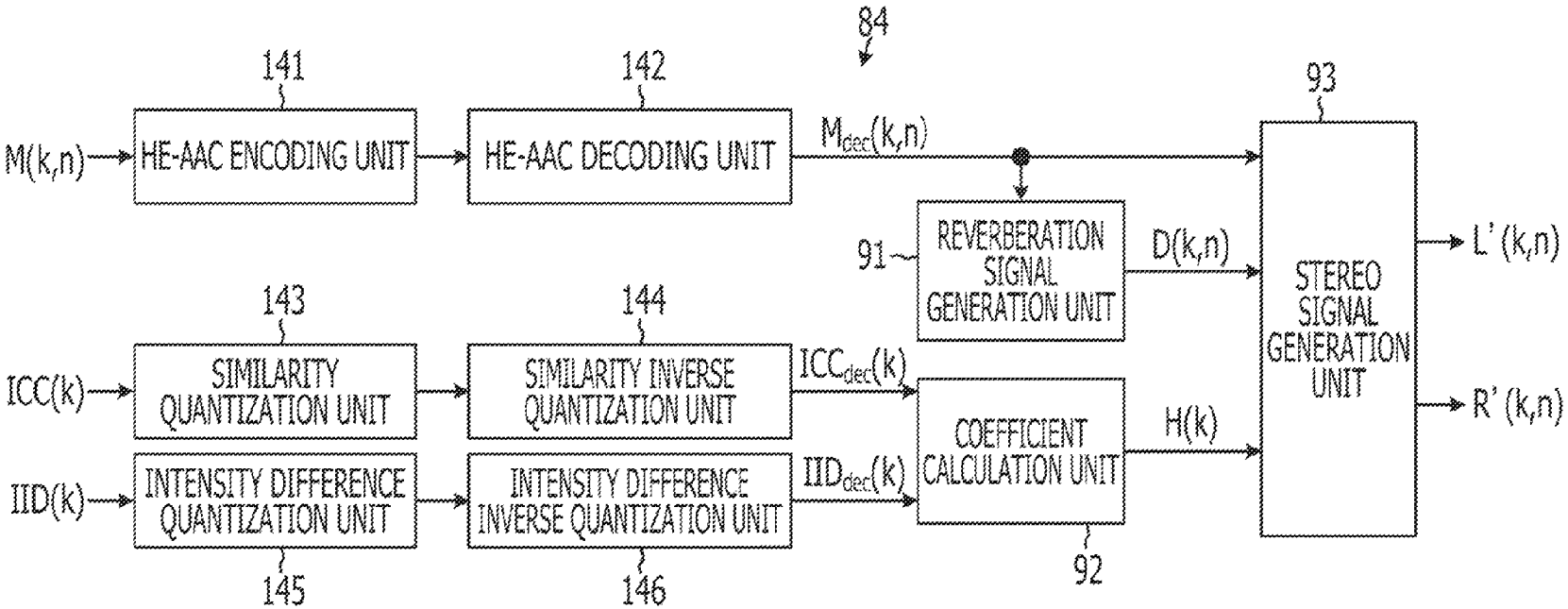
FIG. 14 is a block diagram illustrating a decoded signal estimation unit of an encoder according to a third embodiment.

FIG. 14 is a block diagram illustrating a decoded signal estimation unit of an encoder according to a third embodiment. As illustrated in FIG. 14, the decoded signal estimation unit 84 includes an HE-AAC encoding unit 141, an HE-AAC decoding unit 142, a similarity quantization unit 143, a similarity inverse quantization unit 144, an intensity difference quantization unit 145, and an intensity difference inverse quantization unit 146. The HE-AAC encoding unit 141 generates data obtained by encoding a monaural signal M(k, n). The HE-AAC decoding unit 142 generates a decoded monaural signal $M_{dec}$(k, n) by decoding the data that is output from the HE-AAC encoding unit 141. The similarity quantization unit 143 quantizes the similarity ICC (k). The similarity inverse quantization unit 144 inverse-quantizes the data that is output from the similarity quantization unit 143 to generate an inverse-quantized $ICC_{dec}$ (k). The intensity difference quantization unit 145 quantizes an intensity difference IID(k). The intensity difference inverse quantization unit 146 inverse-quantizes the data that is output from the intensity difference quantization unit 145 to generate an inverse-quantized $IID_{dec}$ (k).

The reverberation signal generation unit 91 generates a reverberation signal D(k, n) based on the decoded monaural signal $M_{dec}$(k, n). The coefficient calculation unit 92 generates a coefficient matrix H(k) based on the inverse-quantized $ICC_{dec}$ (k) and $IID_{dec}$ (k). The stereo signal generation unit 93 generates the decoded signals L'(k,n), and R'(k,n) based on the decoded monaural signal $M_{dec}$(k, n), the reverberation signal D(k, n), and the coefficient matrix H(k). The L'(k,n), and R'(k,n) are represented by the following expression (38).

Expression 38

$$\left.\begin{aligned} L'(k,n) &= h_{11}M_{dec}(k,n) + h_{12}D(k,n) \\ R'(k,n) &= h_{21}M_{dec}(k,n) + h_{22}D(k,n) \end{aligned}\right\} \quad (38)$$

Figure 15:
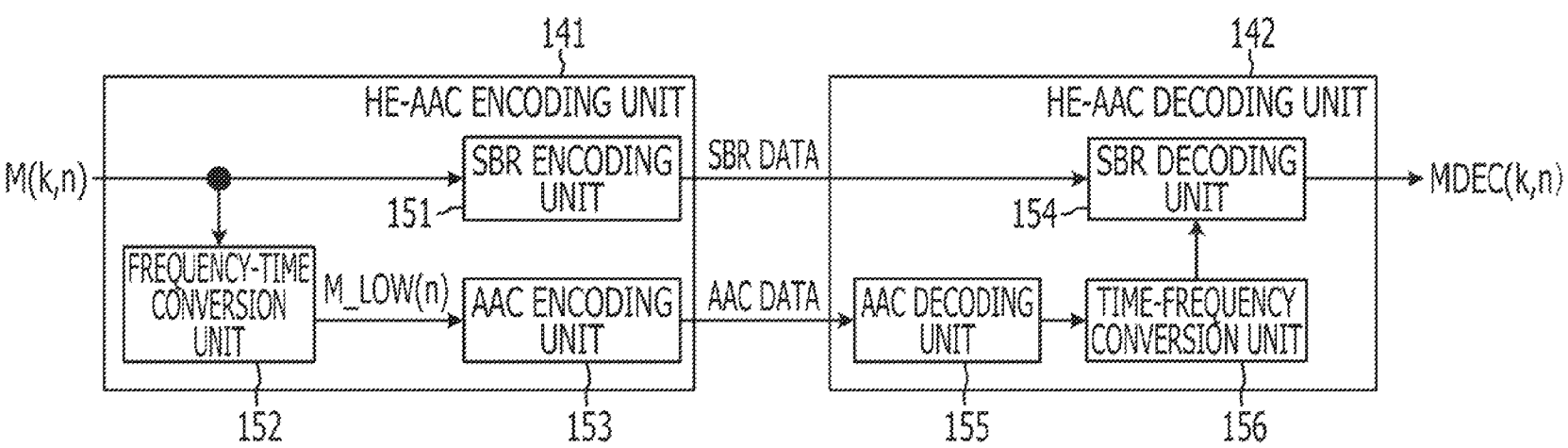
FIG. 15 is a block diagram illustrating an HE-AAC encoding unit and an HE-AAC decoding unit of the encoder according to the third embodiment.

FIG. 15 is a block diagram illustrating an HE-AAC encoding unit and an HE-AAC decoding unit of the decoded signal estimation unit. As illustrated in FIG. 15, the HE-AAC encoding unit 141 includes an SBR encoding unit 151, a frequency-time conversion unit 152, and an MC encoding unit 153. The HE-AAC encoding unit 141 is substantially the same as the HE-AAC encoding unit 45 described in the second embodiment, thus the description will be omitted.

The HE-AAC decoding unit 142 includes an SBR decoding unit 154, an MC decoding unit 155, and a time-frequency conversion unit 156. The MC decoding unit 155 decodes data that is output from the MC encoding unit 153. The time-frequency conversion unit 156 applies time-frequency conversion to data that is output from the MC decoding unit 155 and supplies the data to the SBR decoding unit 154. The SBR decoding unit 154 generates a decoded monaural signal $M_{dec}$ (k, n) based on a high-frequency component obtained by decoding the SBR data that is output from the SBR encoding unit 151 and a medium-low frequency component that is supplied from the time-frequency conversion unit 156. The details of the HE-AAC decoding unit 142 is disclosed, for example, in specification of ISO/IEC 13818-7:2006.

FIG. 16 illustrates an example of a similarity quantization table. A similarity quantization table 161 illustrated in FIG. 16 is, for example, disclosed in non-patent literature, ISO/IEC 14496-3: 2005, "Information technology—Coding of audio-visual objects—Part 3: Audio." In the example illustrated in FIG. 16, a possible range of values of the similarity (ICC(k)=ρ) is −1 to +1. The similarity quantization unit 143 selects an index with a quantized value that is substantially the closest to similarity ρ (ICC(k)) calculated by the similarity calculation unit 82 from the similarity quantization table 161. For example, when the similarity ρ is 0.6, the similarity quantization unit 143 selects an index 3. When the similarity ρ is an intermediate value between adjacent indices, one of the two indices is selected.

The similarity inverse quantization unit 144 refers to the similarity quantization table 161 and obtains an inverse quantized value of similarity that corresponds to the index selected by the similarity quantization unit 143. For example, when the index is 3, the inverse quantized value of similarity is 0.60092. The similarity quantization table 161 may be written in the encode program 31. The similarity quantization table 161 is not limited to the one disclosed in the non-patent literature 1, but may be set as appropriate.

FIG. 17 illustrates an example of an intensity difference quantization table. In the example illustrated in FIG. 17, an intensity difference quantization table 162 is, for example, disclosed in the above-described non-patent literature 1. In the example of FIG. 17, a possible range of values of the intensity difference IID(k) is −25 dB to +25 dB. The intensity difference quantization unit 145 selects an index with a quantized value that is substantially the closest to an intensity difference IID(k) calculated by the intensity difference calculation unit 81 from the intensity difference quantization table 162. For example, when the intensity difference IID(k) is 10.8 dB, the intensity difference quantization unit 145 selects an index 4. When the intensity difference IID(k) is an intermediate value between adjacent indices, one of the two indices is selected.

The intensity difference inverse quantization unit 146 refers to the intensity difference quantization table 162 and obtains an inverse quantized value of the intensity difference that corresponds to the index selected by the intensity difference quantization unit 145. For example, when the index is 4, the inverse quantized value of intensity difference is 10. The intensity difference quantization table 162 may be written in the encode program 31. The intensity difference quantization table 162 is not limited to the one disclosed in the non-patent literature 1, but may be set as appropriate. Other configurations are the same as those of the second embodiment, and thereby will not be described.

According to the third embodiment, substantially the same advantages as those of the second embodiment may be achieved. Encoding may be achieved that takes account of error and data distortion that may be caused during a decoding process of the device at the decoding process side by encoding a monaural signal M(k, n) once and decoding the monaural signal M(k, n) and quantizing similarity between the channels ICC(k) once and an intensity difference between the channels IID(k), and inverse-quantizing the ICC(k) and IID (k) prior to calculating decoded signals L'(k, n) and R'(k, n). In the above-description, as an example, a parametric stereo coding method is described; however the coding method according to the embodiments is not limited to the parametric stereo coding method but a coding method that encodes phase information may be applied.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An encoding device comprising:

a processor; and a memory which stores a plurality of instructions, which when executed by the processor, cause the processor to execute estimating a decoded signal of a plurality of channels based on a down-mix signal obtained by down-mixing an input signal of the plurality of channels, similarity between the channels of the input signal, and an intensity difference between the channels of the input signal;

analyzing a phase difference between a signal of one channel of the input signal and a down-mix signal obtained by downmixing the input signal, and a phase difference between a signal of one channel of the decoded signal and a down-mix signal obtained by down-mixing the decoded signal;

calculating phase information based on the phase difference between the signal of one channel of the input signal and the down-mix signal obtained by down-mixing the input signal, and the phase difference between the signal of one channel of the decoded signal and the down-signal obtained by down-mixing the decoded signal; and encoding the similarity between the channels of the input signal, the intensity difference between the channels of the input signal, and the phase information.

2. The device according to the claim 1, wherein the processor further analyzes a phase difference between the channels of the input signal and analyzes a phase difference between channels of the decoded signal, wherein the processor calculates the phase information based on the phase difference between the channels of the input signal, and the phase difference between channels of the decoded signal.

3. An encoding system comprising:

a processor; and a memory which stores a plurality of instructions, which when executed by the processor, cause the processor to execute converting an input signal of a plurality of channels into a frequency signal of the plurality of channels;

down-mixing the frequency signal of the plurality of channels;

encoding the down-mixed signal;

converting the down-mixed signal into a time-domain signal;

encoding the time-domain signal;

calculating similarity between channels based on the time-domain signal;

calculating an intensity difference between channels based on the time-domain signal;

estimating a decoded signal of the plurality of channels based on the similarity, the intensity difference, and the down-mixed signal;

analyzing a phase difference between a signal of one channel of the input signal and the down-mixed signal, and a phase difference between a signal of one channel of the decoded signal and a down-mix signal obtained by down-mixing the decoded signal;

calculating phase information based on the phase difference between the signal of one channel of the input signal and the down-mix signal obtained by down-mixing the input signal, and the phase difference between the signal of one channel of the decoded signal and the down-signal obtained by down-mixing the decoded signal;

encoding the similarity, the intensity difference, and the phase information; and generating an output code by multiplexing output data of the encoded down-mixed signal, output data of the encoded time-domain signal and output data of the encoded similarity, intensity difference and phase information.

4. The system according to the claim 3, wherein the processor further analyzes a phase difference between the channels of the input signal and analyzes a phase difference between channels of the decoded signal, wherein the processor calculates the phase information based on the phase difference between the channels of the input signal, and the phase difference between channels of the decoded signal.

5. The system according to the claim 4, wherein the processor calculates the phase difference based on a difference of a phase of the frequency signal of the plurality of channels and a phase of the estimated signal.

6. The system according to the claim 3, wherein the processor calculates the phase difference based on a difference of a phase of the frequency signal of the plurality of channels and a phase of the estimated signal.

7. An encoding method comprising:

estimating a decoded signal of a plurality of channels based on a down-mix signal obtained by down-mixing an input signal of the plurality of channels, similarity of channels of the input signal, and an intensity difference between the channels of the input signal;

analyzing a phase difference between a signal of one channel of the input signal and a down-mix signal obtained by downmixing the input signal, and a phase difference between a signal of one channel of the decoded signal and a down-mix signal obtained by down-mixing the decoded signal;

calculating phase information based on the phase difference between the signal of one channel of the input signal and the down-mix signal obtained by down-mixing the input signal, and the phase difference between the signal of one channel of the decoded signal and the down-signal obtained by down-mixing the decoded signal; and encoding the similarity between the channels of the input signal, the intensity difference between the channels of the input signal, and the phase information.

8. The method according to the claim 7, wherein the analyzing further analyzes a phase difference between the channels of the input signal and analyzes a phase difference between channels of the decoded signal, wherein the calculating calculates the phase information based on the phase difference between the channels of the input signal, and the phase difference between channels of the decoded signal.

* * * * *